United States Patent [19]

Sheen

[11] Patent Number: 4,976,287

[45] Date of Patent: Dec. 11, 1990

[54] COUPLING PORTION OF AN OUTLET PIPE OF A TAP

[76] Inventor: Guang Y. Sheen, No. 5, Lane 215, Yung Ho St., Taichung, Taiwan

[21] Appl. No.: 470,336

[22] Filed: Jan. 25, 1990

[51] Int. Cl.[5] ..... E03C 1/02

[52] U.S. Cl. ..... 137/801; 137/606; 137/615; 285/281

[58] Field of Search ..... 137/606, 615, 801; 285/280, 281

[56] References Cited

U.S. PATENT DOCUMENTS 4,037,624 7/1977 Turner et al. ..... 137/801 X
4,346,735 8/1982 Raz ..... 137/801 X
4,456,287 6/1984 Bisonaya ..... 137/801 X
4,592,388 6/1986 Wilcox ..... 137/801 X

*Primary Examiner*—Gerald A. Michalsky
*Attorney, Agent, or Firm*—Keaty & Keaty

[57] ABSTRACT

A tap includes a seat, two valves disposed on both ends of the seat, an outlet pipe rotatably provided on a center portion of the seat, a connecting pipe communicating the valves and the outlet pipe. A sleeve is disposed on the center portion of the seat. A collar is slidable in the sleeve and embraces a lower end of the outlet pipe. A retaining means is provided between the collar and the connecting pipe for rotatably holding the lower end of the outlet pipe so that the outlet pipe is stably and rotably held in the sleeve.

2 Claims, 3 Drawing Sheets

COUPLING PORTION OF AN OUTLET PIPE OF A TAP

BACKGROUND OF THE INVENTION

The present invention relates to a tap, and more particularly to a coupling portion of an outlet pipe of a tap.

A coupling portion of an outlet pipe of a tap which is used nowadays is shown in FIG. 4. A lower end of the outlet pipe P is rotatably disposed in a sleeve S so that a position of an outlet opening of the outlet pipe P is adjustable. A sealing ring R is disposed between the outlet pipe P and the sleeve S for making a water seal engagement therebetween. The outlet pipe P can not be stably held in position and may make a frictional contact with the inner surface of the sleeve S. These have a tendency to suffer from wear and corrosion.

The present invention has arisen to mitigate and/or obviate the afore-described disadvantages of the conventional tap.

SUMMARY OF THE INVENTION

The primary objective of the present invention is to provide a coupling portion of an outlet pipe of a tap in which the outlet pipe of the tap is stably held on the seat of the tap.

According to one aspect of the invention, there is provided a tap which includes a seat, two valves disposed on both ends of the seat, an outlet pipe rotatably provided on a center portion of the seat, a connecting pipe communicating the valves and the outlet pipe. A sleeve is disposed on the center portion of the seat. A collar is slidable in the sleeve and embraces a lower end of the outlet pipe. A retaining means is provided between the collar and the connecting pipe for rotatably holding the lower end of the outlet pipe so that the outlet pipe is stably and rotatably held in the sleeve.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
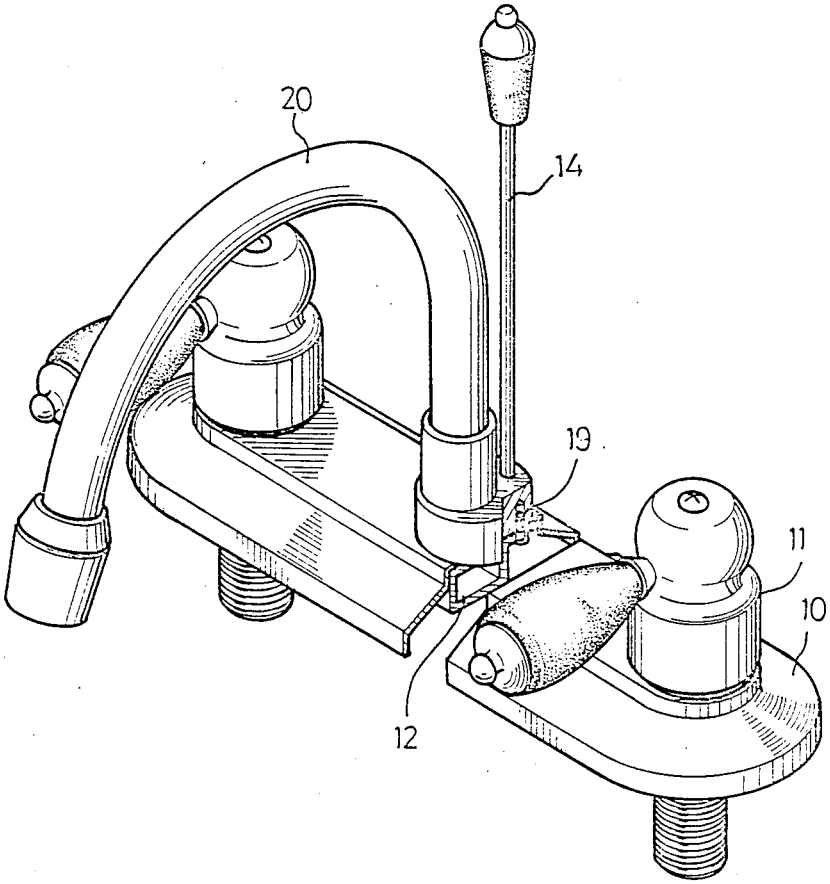
FIG. 1 is a perspective view of a tap in accordance with the present invention.

Referring to the drawings and initially to FIG. 1, the tap in accordance with the present invention comprises generally a seat 10 disposed on an upper portion of a sink (not shown), two valves 11 disposed on both ends of the seat 10, an outlet pipe 20 rotatably disposed on the center portion of the seat 10, a connecting pipe 12 communicating with the two valves 11 and the outlet pipe 20, and a pull rod 14 being vertically disposed behind the outlet pipe 20 and being actuated to close and open a discharge pipe of the sink.

Figure 2:
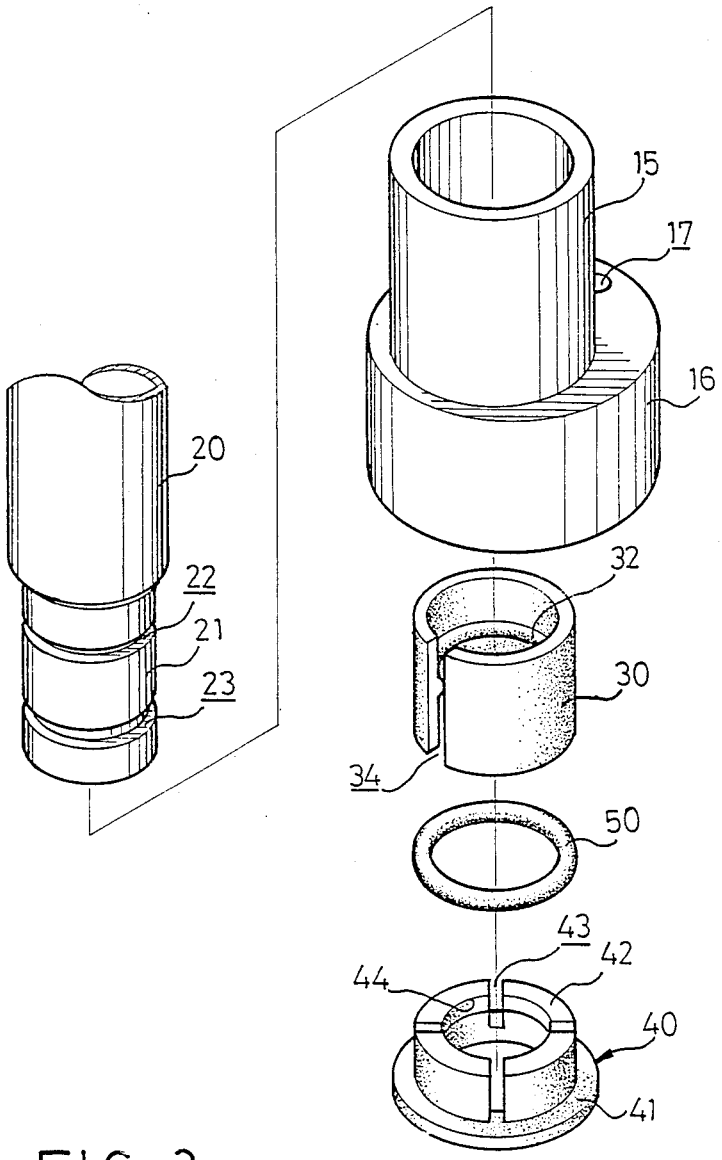
FIG. 2 is an exploded view of a coupling portion of the tap.
Figure 3:
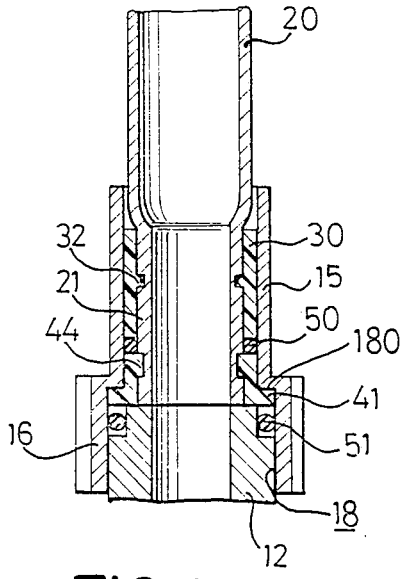
FIG. 3 is a cross sectional view of the coupling portion of the tap of FIG. 2.
Figure 4:
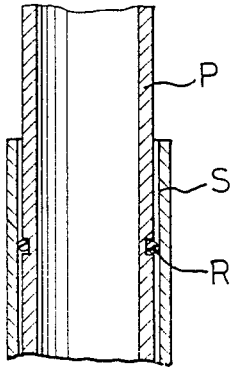
FIG. 4 PRIOR ART
FIG. 4 is a cross sectional view, illustrating a coupling portion of a conventional tap.

Referring next to FIGS. 2 and 3, the coupling portion of the outlet pipe 20 comprises a sleeve 15 with an enlarged based portion 16 being fixed on the seat 10 by screws 19 (FIG. 1) or the like. The enlarged base portion 16 is substantially eccentric relative to the sleeve 15. A hole 17 is formed on the enlarged base portion 16 for receiving the pull rod 14. A hole 18 runs through the enlarged base portion 16 and is concentric with the sleeve 15. The diameter of the hole 18 is larger than the inner diameter of the sleeve 15 so that a shoulder 180 is formed between the sleeve 15 and the enlarged base portion 16.

A reduced diameter portion 21 is formed on a lower end of the outlet pipe 20. Two annular grooves 22, 23 are formed on the reduced diameter portion of the outlet pipe 20. A collar 30 which is preferably made of plastic materials has an annular ring 32 formed in a center portion thereof. A split 34 is vertically formed on the collar 30 so that the collar 30 is substantially resilient. The collar 30 surrounds and embraces the reduced diameter portion 21 of the outlet pipe 20. The annular ring 32 of the collar 30 is engaged within the annular groove 22 of the reduced diameter portion 21 of the outlet pipe 20. The collar 30 is preferably made of Teflon, plastic materials or the like so that the collar 30 is freely rotatable in the sleeve 15. The contact area between the collar 30 and the sleeve 15 is large so that the outlet pipe 20 is stably held in the sleeve 15.

A collet chuck 40 which has a substantially Z-shaped cross section has four blades 42 and four splits 43. The blades 42 are resilient. An outer flange 41 is formed on the lower end of the collet chuck 40 and extends radially outwards, and an inner flange 44 is formed on the upper ends of the blades 42 and extends radially inwards. The collet chuck 40 is disposed between the collar 30 and the connecting pipe 12, and surrounds and embraces the lower end of the reduced diameter portion 21 of the outlet pipe 20. The inner flange 44 is engaged within the annular groove 23 of the outlet pipe 20 and the outer flange 41 contacts and bears against the shoulder 180 of the sleeve 15 so that the outlet pipe 20 is rotatably retained in the sleeve 15. The lower end of the outlet pipe 20 communicates with the connecting pipe 12. The outer flange 41 of the collet chuck 40 limits a vertical movement of the outlet pipe 20. The collet chuck 40 is preferably made of Teflon, plastic materials or the like so that the collet chuck 40 is freely rotatably in the sleeve 15. The collar 30 and the collet chuck 40 stably hold the outlet pipe 20 in the sleeve 15 so that the outlet pipe 20 stably rotates relative to a longitudinal axis of the sleeve 15 only.

A sealing ring 50 is disposed between the collar 30 and the collet chuck 40 so as to make a water tight seal between the outlet pipe 20 and the sleeve 15. A sealing ring 51 is disposed on the outer surface of the upper end of the connecting pipe 12 in order to make a water tight seal between the connecting pipe 12 and the enlarged base portion 16.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A coupling portion of an outlet pipe of a tap, said tap comprising a seat, two valves disposed on both ends of the seat, an outlet pipe rotatably provided on a center portion of said seat, a connecting pipe communicating said valves and said outlet pipe; characterized in that a sleeve is disposed on said center portion of said seat and communicates with said connecting pipe, a shoulder is formed in a middle portion of said sleeve; a collar which is slidable in an upper portion of said sleeve and embraces a lower end of said outlet pipe, wherein said lower end of said outlet pipe has a reduced diameter and has an upper annular groove and a lower annular groove formed on an outer surface thereof, an annular ring is formed in said collar and engages with said upper annular groove of said lower end of said outlet pipe, so that said lower end of said outlet pipe is stably held in said sleeve; and a retaining means is provided between said collar and said connecting pipe; an inner flange is formed on an upper end of said retaining means and extends radially inwards, and an outer flange is formed on a lower end of said retaining means and extends radially outwards, said outer flange of said retaining means bears against said shoulder of said sleeve and said inner flange of said retaining means is engaged in said lower annular groove of said lower end of said outlet pipe, so that said retaining means rotatably holds said lower end of said outlet pipe and, so that said outlet pipe is stably and rotatably held in said sleeve.

2. A coupling portion of an outlet pipe of a tap according to claim 1, wherein said a split is vertically formed on said collar so that said collar is substantially resilient; a first sealing ring is disposed between said collar and said retaining means for making a water seal tight between said outlet pipe and said sleeve; said retaining means is substantially cylindrical with a plurality of blades and a plurality of splits vertically formed thereon so that said blades are resilient; and a second sealing ring is disposed on an upper and outer surface of said connecting pipe for making a water seal tight between said connecting pipe and said sleeve.

* * * * *